US010716389B2

(12) United States Patent
Moreau et al.

(10) Patent No.: US 10,716,389 B2
(45) Date of Patent: Jul. 21, 2020

(54) AFFIXABLE AND REMOVABLE CLIP

(71) Applicant: Pure Safety Group, Inc., Pasadena, TX (US)

(72) Inventors: Darrell A. Moreau, Manchester, NH (US); Andre W. Moreau, Bedford, NH (US)

(73) Assignee: Pure Safety Group, Inc., Pasadena, TX (US)

( * ) Notice: Subject to any disclaimer, the term of this patent is extended or adjusted under 35 U.S.C. 154(b) by 0 days.

(21) Appl. No.: 15/939,874

(22) Filed: Mar. 29, 2018

(65) Prior Publication Data

US 2019/0298042 A1 Oct. 3, 2019

(51) Int. Cl.
*A45F 5/00* (2006.01)
*A45F 5/02* (2006.01)

(52) U.S. Cl.
CPC ..... *A45F 5/00* (2013.01); *A45F 5/021* (2013.01); *A45F 2005/006* (2013.01); *A45F 2200/0575* (2013.01)

(58) Field of Classification Search
CPC ..... Y10S 224/904; A45F 5/004; A45F 5/021; A45F 2005/006; A45F 2200/0575; F41C 33/02; F41C 33/0209; F41C 33/0218; F41C 33/0227; F41C 33/0236; F41C 33/0245; F41C 33/0254; F41C 33/0263; F41C 33/0272; F41C 33/0281; F41C 33/029; F41C 33/04; F41C 33/041; F41C 33/043; F41C 33/045; F41C 33/046; F41C 33/048
USPC ..... 224/904, 192–193, 198, 238, 243
See application file for complete search history.

(56) References Cited

U.S. PATENT DOCUMENTS

| | | | |
|---|---|---|---|
| 1,977,096 | A | 10/1934 | Straubel |
| 2,420,021 | A | 5/1947 | Straubel et al. |
| D226,040 | S | 1/1973 | Beerli, Jr. |
| 3,934,368 | A | 1/1976 | Fearing |
| D268,848 | S | 5/1983 | Lorber |
| 4,419,794 | A | 12/1983 | Horton, Jr. et al. |
| 4,667,374 | A | 5/1987 | Bianchi |
| 4,690,315 | A | 9/1987 | Bianchi |
| 4,828,153 | A | 5/1989 | Guzik et al. |
| 4,903,745 | A | 2/1990 | Roman |
| D314,012 | S | 1/1991 | Klodt |

(Continued)

FOREIGN PATENT DOCUMENTS

| | | |
|---|---|---|
| JP | D1275921 | 7/2006 |
| WO | 2017065663 A1 | 4/2017 |

OTHER PUBLICATIONS

2019 EDC Gear Multi Function Sheath Scabbard Belt Clip, DHGate website, screen grab from May 13, 2019.

(Continued)

*Primary Examiner* — Scott T McNurlen
(74) *Attorney, Agent, or Firm* — Dicke, Billig & Czaja, PLLC

(57) ABSTRACT

A clip comprising a base portion with a base terminal end opposite a base connected end, a connector portion attached to the base portion at the base connected end, an anchor portion with an anchor terminal end opposite an anchor connected end wherein the anchor connected end is connected to the connector portion, and a fastener attached to the anchor portion and non-destructively removably attached to the base portion proximate the base terminal end.

19 Claims, 6 Drawing Sheets

(56) References Cited

U.S. PATENT DOCUMENTS 5,018,653 A * 5/1991 Shoemaker ..... F41C 33/0227 224/193
5,341,975 A * 8/1994 Marinescu ..... A45F 5/02 224/269
D353,221 S 12/1994 Scott et al.
5,369,846 A 12/1994 Suarez et al.
5,528,770 A 6/1996 Castilla et al.
D385,417 S 10/1997 White et al.
5,743,451 A * 4/1998 Kahn ..... A45F 5/02 224/268
D412,343 S 7/1999 Offenhauer
D429,068 S 8/2000 Kleinsmith
D433,715 S 11/2000 Bartz
6,189,756 B1 2/2001 Ward
D465,525 S 11/2002 Dilday
6,752,299 B2 6/2004 Shetler et al.
6,994,238 B2 2/2006 Estabaya
D541,346 S 4/2007 Lau
D559,714 S 1/2008 Liao
7,320,420 B2 1/2008 Buis et al.
D580,981 S 11/2008 Lau
D608,093 S 1/2010 Moore
7,665,684 B2 2/2010 Salentine et al.
8,322,586 B2 12/2012 Davis
D677,193 S 3/2013 MacDonald
8,794,560 B2 8/2014 Salentine et al.
9,072,364 B2 * 7/2015 Johnson ..... A45F 5/02
9,232,850 B2 * 1/2016 Moreau ..... A45F 5/02
9,360,276 B1 6/2016 Meek
D806,529 S 1/2018 Olenick
2002/0174521 A1 * 11/2002 Vidal, Jr. ..... A45F 5/004 24/3.1
2003/0047575 A1 3/2003 Enkerlin et al.
2003/0141330 A1 7/2003 McDonald et al.
2005/0279787 A1 * 12/2005 Davis ..... A45F 5/02 224/232
2006/0175365 A1 * 8/2006 Sandler ..... A45F 3/14 224/201
2010/0243690 A1 * 9/2010 Lerch ..... A45F 5/02 224/198
2015/0192388 A1 * 7/2015 Blach ..... F41C 33/041 224/660
2015/0238002 A1 * 8/2015 Kinskey ..... A45F 5/021 224/681
2016/0324301 A1 11/2016 Babb et al.
2017/0005686 A1 * 1/2017 Borisen ..... H04B 1/3888
2017/0290410 A1 10/2017 Evans et al.
2017/0304605 A1 10/2017 Newell et al.
2019/0126018 A1 5/2019 Browd et al.

OTHER PUBLICATIONS

Milwaukee Adjustable Electricians Work Belt—48-22-8110, The Home Depot website 2019, screen grab from May 13, 2019.
AA-10 Backpack Mountclip, Nikon website 2019, screen grab from May 13, 2019.
International Search Report from PCT/US2019/024592; 4 pages; Carols Nicolas; Jul. 12, 2019.

* cited by examiner

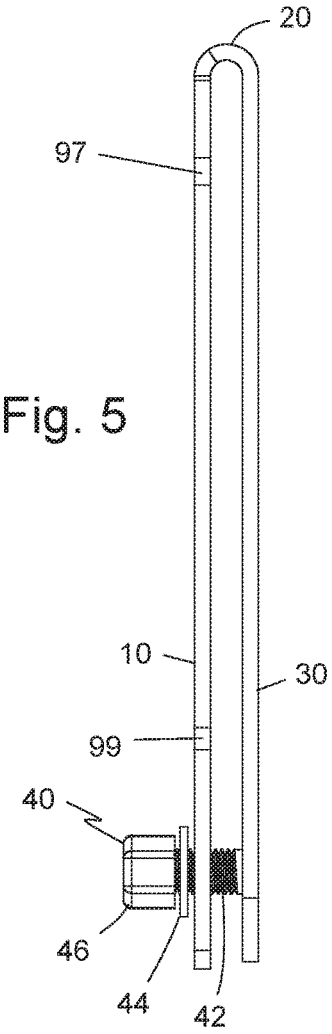
Fig. 5
Fig. 6
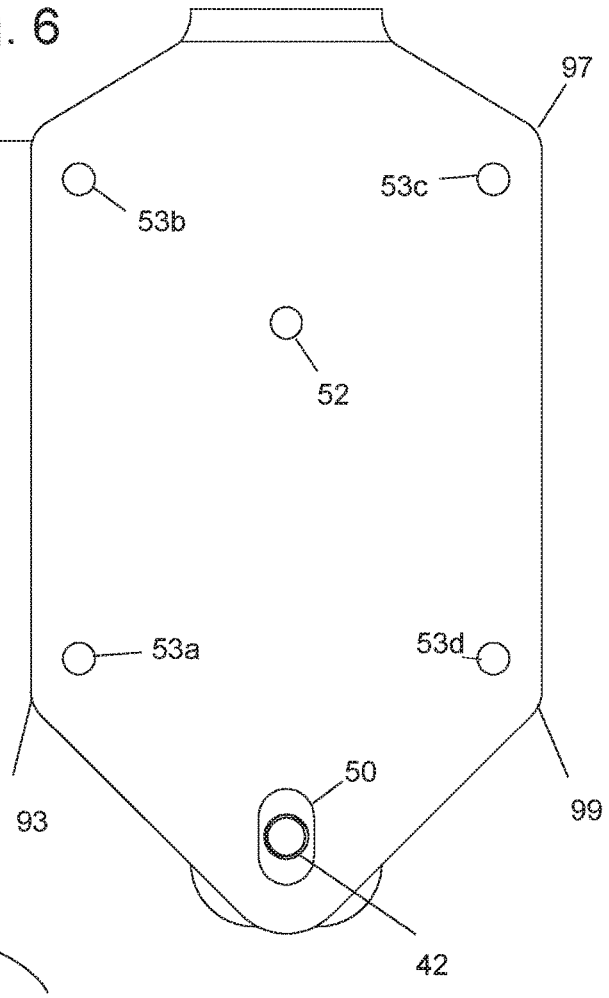
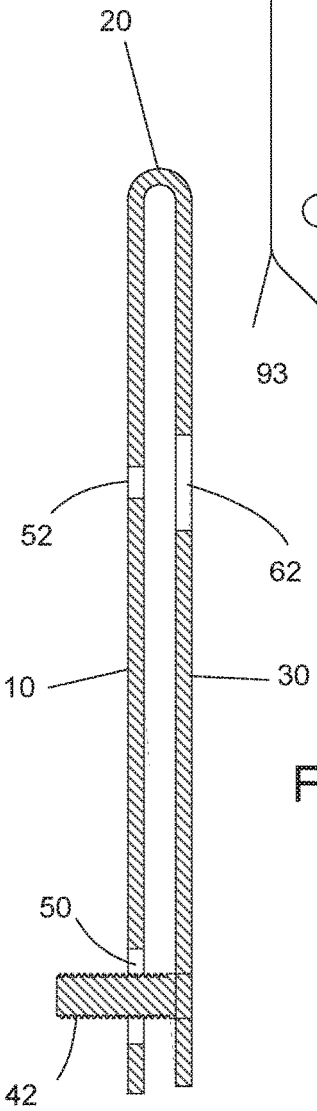
Fig. 7

AFFIXABLE AND REMOVABLE CLIP

BACKGROUND OF THE INVENTION

1. Field of the Invention

The present invention relates generally to tools and accessories. Particularly, the present invention relates to lanyards and lanyard connectors.

2. Description of the Prior Art

Hand tools are widely used in construction, maintenance, and industrial facilities operations. Some tasks require work to be performed at elevated heights; for such tasks, dropping a tool can result in injury to individuals, equipment, objects, and the tool itself. Tools may be secured to relatively stationary objects such as structures, people, or articles of clothing to prevent the unintentional falling of a tool. Previous methods for securing tools include holding tools in a receptacle while not in use, tethering tools to the user, and attaching tools to a nearby structure via a lanyard.

One approach of dropped tool prevention is disclosed in US Published Application No. 2017/0290410-A1 to Evans. The Evans publication discloses a clip for securing articles to a belt. The Evans clip has a semi-flexible central tear-drop shaped bend opposite spaced apart ends. The spaced apart ends are connected to a first leg and a second leg which extend in a generally parallel relationship. The Evans clip further includes a locking collar member which connects to the spaced apart ends.

Another approach of dropped tool prevention is disclosed in U.S. Pat. No. 9,360,276 to Meek for a reversible holster holder. The holster holder can be reversibly configured to mount a belt-attaching holster to a vertical surface in either a left-handed or right-handed arrangement. This belt-attaching holster potentially includes a belt loop and/or a belt clip.

Another approach of dropped tool prevention is disclosed in U.S. Pat. No. 4,667,374 to Bianchi for a holster clip. The holster clip has a recess on one leg such that a portion of the wearer's belt is deflected into the recess by the opposite clip leg. This mechanism anchors the clip, its associated holster, and the tool within the holster to the belt to protect against inadvertent dislodgement.

SUMMARY OF THE INVENTION

Holsters can be used to store and carry a variety of tools. Different types of holsters store different types of tools and are often molded to the type of tool they are intended to store and carry. For example, a holster may store and carry a hammer, a screwdriver, a power screwdriver, or a firearm, and each of these holsters may be molded into a different shape to better fit the particular tool it holds. Holsters are often attached to relatively stationary objects. Relatively stationary objects may include structures, people, and articles of clothing.

Some tool holsters are attached to tool belts. Attaching a tool holster to a tool belt allows a user to store and carry specific tools which may not otherwise be accommodated by the tool belt. The tool belt may be supported on a user. Typically, the tool in the holster is untethered. However, when working at heights, a worker may attach a tool tether to the tool in the holster and then connect the other end of the tool tether to the worker's belt or to an anchoring point on the separate tool belt.

Tool belts typically have multiple tools attached including, for example, retractable tool tethers. However, the real estate on tool belts is at a premium. As such, a major disadvantage to tethering directly to a tool belt is the use of this premium real estate as this space may otherwise be used for other tools, reducing the need for additional trips away from the work site to trade out tools. One way to solve this problem is to use additional locations for attaching a tether. One such additional location is a tool holster. Using a tool holster for an anchoring point has multiple advantages such as leaving additional space available on the tool belt for other tool holsters.

Previous methods can be improved upon by further providing an affixable and removable clip fixedly attached to a holster, which affixable and removable clip may act as an anchoring point for a tool lanyard.

It is an object of the present invention to provide lanyard connection point for hand tool lanyards.

It is another object of the present invention to provide a lanyard connection point for hand tools that does not occupy limited available positions on a tool belt.

It is still another object of the invention to provide a space efficient mechanism for attaching tools to a tool belt.

The present invention achieves these and other objectives by providing an affixable and removable clip to secure a tool lanyard between a hand tool and a tool holster. In one embodiment of the present invention, the affixable and removable clip has a base portion, an anchor portion parallel and opposite the base portion and spaced from the base portion, and a connector portion that connects one end of the base portion to a corresponding end of the anchor portion. The base portion has a first base portion, a second base portion, and a third base portion. The second base portion connects the first base portion to the third base portion. The base portion has a first base aperture through the third base portion, a base terminal end adjacent the third base portion and a base connected end adjacent the first base portion such that the base terminal end is opposite the base connected end. The connector portion is attached to the first base portion at the base connected end. The anchor portion has a first anchor portion, a second anchor portion, and a third anchor portion. The second anchor portion connects the first anchor portion to the third anchor portion. The anchor portion has an anchor terminal end adjacent to the third anchor portion and an anchor connected end adjacent to the first anchor portion. The anchor terminal end is opposite the anchor connected end, and the anchor connected end is connected to the connector portion. The clip further includes a fastener having at least a rod attached to the third anchor portion adjacent the anchor terminal end and a rod attaching component where the at least a rod extends transversely from the anchor portion toward and through the first base aperture of the base portion and the rod attaching component removably attaches to the at least a rod.

In another embodiment, the clip base portion and the clip anchor portion are made of a rigid material and the at least a rod of the fastener is countersunk to the anchor portion.

In still another embodiment of the present invention, the at least a rod is a threaded rod and the fastener further includes a nut removably attached to the threaded rod, and a washer on the threaded rod between the nut and the base portion.

In another embodiment, the base portion has a base length, a base width, and a base thickness. Moreover, the anchor portion has an anchor length, an anchor width, and an anchor thickness, and the anchor portion faces the base portion and is substantially parallel to and spaced from the base portion.

In still another embodiment of the present invention, the base length to the base width defines a base ratio in the range of approximately 1.5:1 to approximately 3:1.

In still another embodiment of the present invention, the anchor length to the anchor width defines an anchor ratio in the range of approximately 1.5:1 and approximately 3:1.

In yet another embodiment of the present invention, the base portion has one or more base apertures, the anchor portion has one or more anchor apertures, and at least one of the one or more anchor apertures is aligned with and concentric to at least one of the one or more base apertures.

In a further embodiment of the present invention, the base portion forms an approximately hexagonal shape with approximate corners, and at least one of the one or more base apertures are near at least one of the one or more approximate corners.

In one embodiment, the anchor portion forms an approximately quadrilateral shape.

In still a further embodiment of the present invention, the connector portion is a bend portion connecting the base portion to the anchor portion.

In one embodiment of the present invention, the apparatus has a base portion with a first base portion, a second base portion, and a third base portion with a first base aperture such that the second base portion connects the first base portion to the third base portion. The apparatus includes an anchor portion with a first anchor portion, a second anchor portion, and a third anchor portion such that the second anchor portion connects the first anchor portion to the third anchor portion. The anchor portion faces the base portion and is parallel and opposed to but spaced from the base portion. The apparatus also includes a connector portion which connects the first base portion to the first anchor portion. Further, the apparatus includes an intervening structure disposed at least partially between the base portion and the anchor portion. Moreover, the apparatus also includes a fastener removably attaching the third base portion and the third anchor portion to the intervening structure.

In another embodiment, the intervening structure is either a belt, a tool belt, a tool holder, a holster, a tool holster, or a tool belt attachment.

In one embodiment, the affixable and removable clip is a unitary clip body with an approximate 180° bend in the clip body forming a base portion and an anchor portion with the bend forming the connector portion where the base portion and the anchor portion are parallel to and spaced from each other. The base portion has a base terminal end opposite the bend and a base connected end adjacent the bend. The anchor portion has an anchor terminal end opposite the bend and an anchor connected end adjacent to the bend. The clip further includes a fastener having at least a rod attached adjacent to the anchor terminal end and a rod attaching component where the at least a rod extends transversely from the anchor portion toward and through a first base aperture adjacent to the base terminal end of the base portion and the rod attaching component removably attaches to the at least a rod.

One embodiment of the present invention is a combination of a tool holster and a clip. This embodiment includes a tool holster having at least one sidewall which is formed into a pouch having a pouch wall. It also includes a clip attached to the tool holster. The clip includes a base portion having a first base aperture through the base portion and disposed adjacent a base terminal end, an anchor portion having a fastener with at least a rod extending transversely from the anchor portion adjacent to an anchor terminal end and a rod attaching component where the at least a rod extends through the first base aperture of the base portion, and a connector portion. The connector portion connects the base portion at a base connected end to the anchor portion at an anchor connected end where the base portion and the anchor portion are facing each other in an opposed parallel orientation and spaced from each. A portion of the pouch wall is disposed between the base portion and the anchor portion with the at least a rod penetrating through the pouch wall and through the first base aperture of the base portion to thereby secure the clip to the pouch wall of the tool holster.

In another embodiment, the at least a rod of the fastener is a threaded rod and wherein the fastener further includes a nut threadably disposed on the threaded rod to thereby secure the clip to the pouch wall.

In still another embodiment of the present invention, the base portion is outside of the pouch and further includes a D-ring secured to the base portion.

In still another embodiment of the present invention, the base portion is outside of the pouch and further includes a retractable lanyard secured to the base portion.

In a further embodiment of the present invention, the base portion is outside of the pouch and further includes a quick-release structure for connecting a hands-free-lanyard assembly between a user and the tool holster.

BRIEF DESCRIPTION OF THE DRAWINGS

FIG. 5 is a top view of the clip of FIG. 1 showing the securing nut removed from the threaded post.

FIG. 6 is a right side plan view of the clip shown in FIG. 1.

FIG. 7 is a cross-sectional, right side view of the clip shown in FIG. 4.

DETAILED DESCRIPTION OF THE INVENTION

Figure 1:
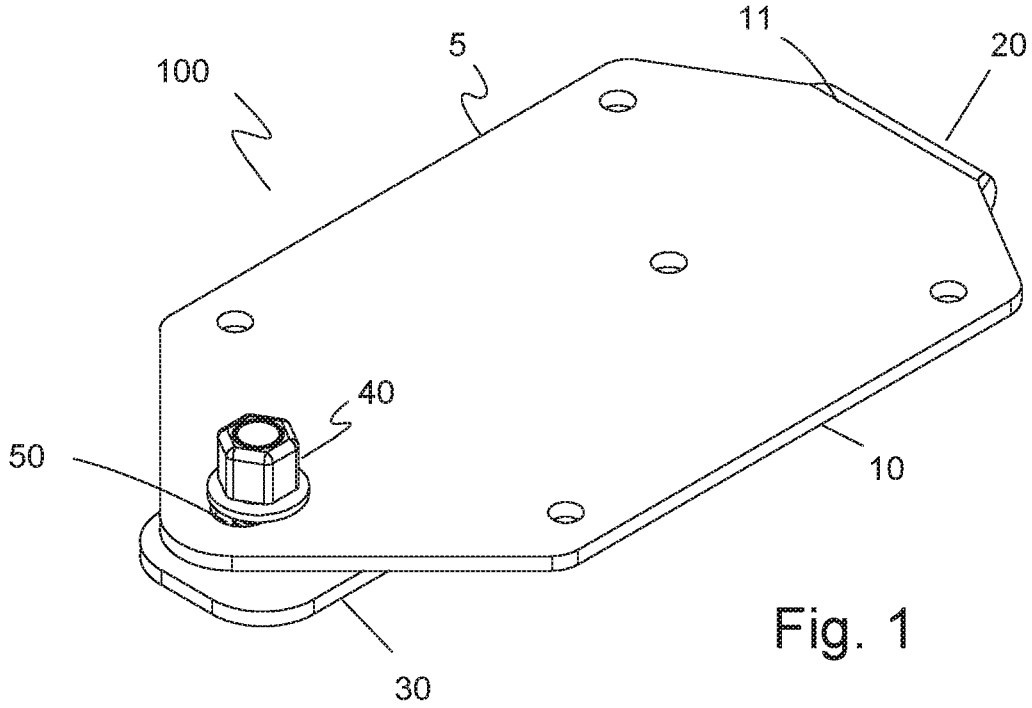
FIG. 1 is a perspective view of one embodiment of the present invention showing an affixable and removable clip.

The preferred embodiments of the present invention are illustrated in FIGS. 1-13. FIG. 1 shows one embodiment of the affixable and removable clip 100 of the present invention having a base portion 10, a connector portion 20, an anchor portion 30, and a fastener 40. Connector portion 20 is between base portion 10 and anchor portion 30 forming a connecting bridge between base portion 10 and anchor portion 30. Base portion 10 is directly connected to connector portion 20 at a base connected end 11. Anchor portion 30 is directly connected to connector portion 20 at an anchor connected end 31 (not shown). Base portion 10 also includes a first base aperture 50. In another embodiment, affixable and removable clip 100 has a unitary clip body 5 having an approximate 180° bend in the clip body 5 where the clip body 5 forms the base portion 10 and the anchor portion 30 and where the bend forms the connector portion 20.

Figure 2:
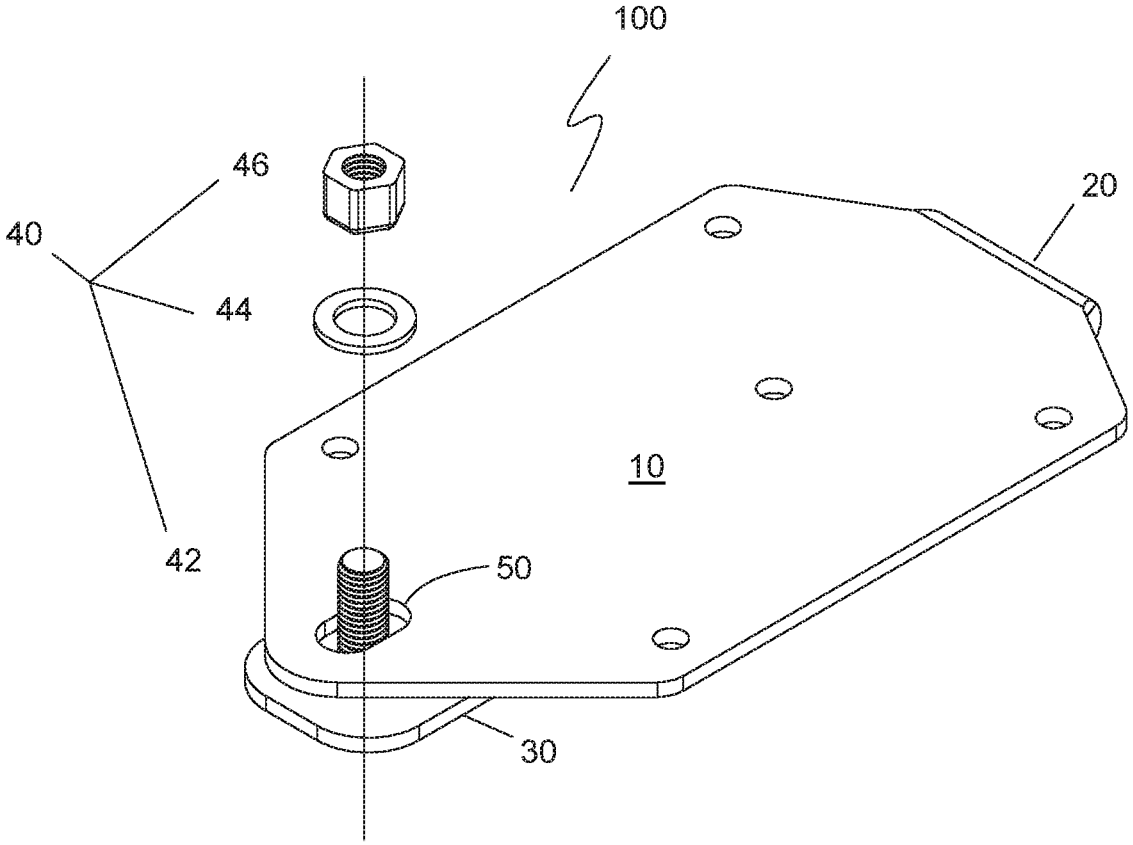
FIG. 2 is an exploded, perspective view of the clip of FIG. 1 showing a securing nut and threaded post.

FIG. 2 shows an exploded view of clip 100 showing fastener 40 having three distinct components 42, 44, 46. In this embodiment, fastener 40 includes a rod 42 extending from anchor portion 30 through first base aperture 50. In this embodiment the at least a rod 42 is a threaded rod. A nut 46 has internal threads that mate with the external threads of threaded rod 42. A washer 44 is disposed between nut 46 and base portion 10.

Figure 3:
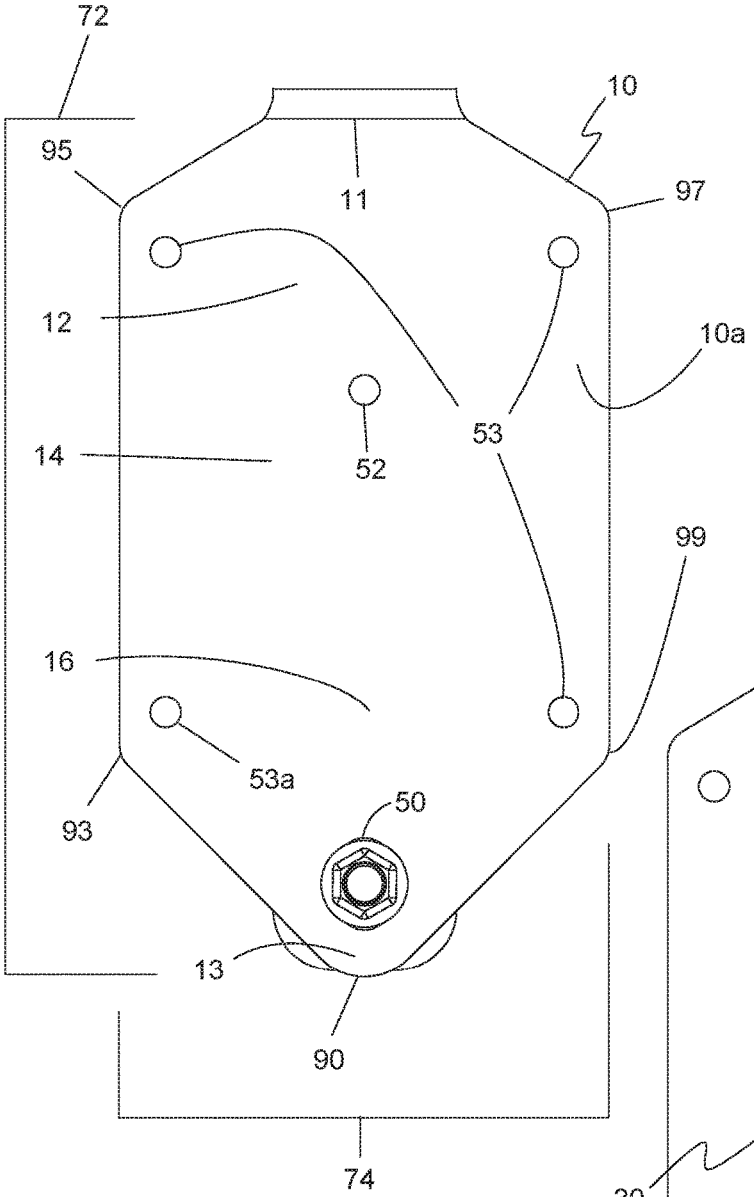
FIG. 3 is a top view of the clip shown in FIG. 1.
Figure 4:
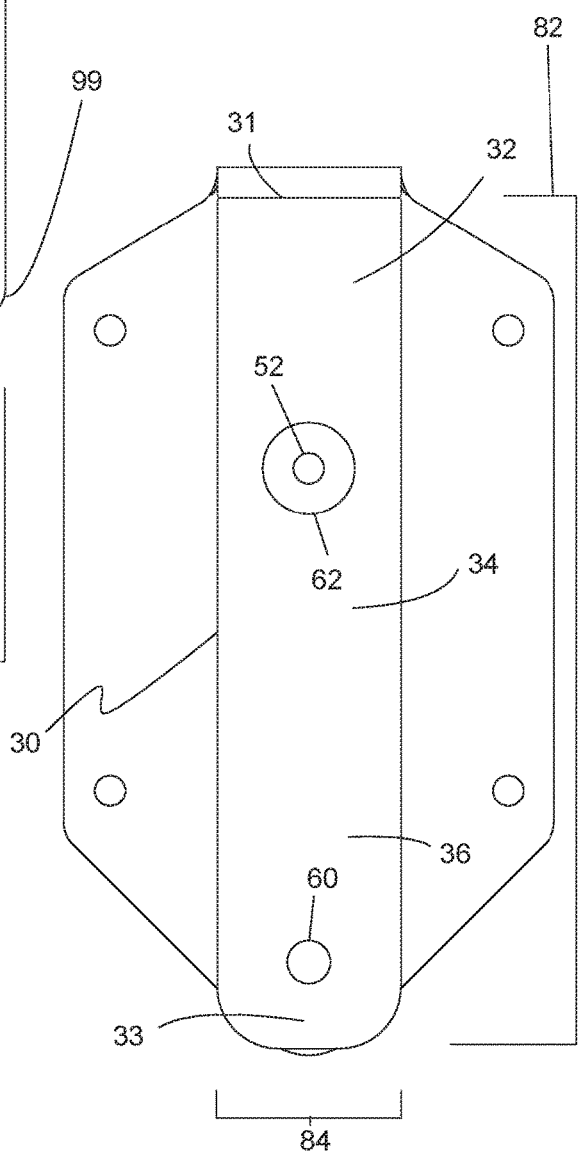
FIG. 4 is a bottom view of the clip shown in FIG. 1.

Turning now to FIGS. 3 and 4, there is illustrated a top, plan view and a bottom plan view of clip 100, respectively. Base portion 10 has a top base surface 10*a* and base portion 10 further includes a first base portion 12, a second base portion 14, and a third base portion 16. First base portion 12 is an area of base portion 10 that includes base connected end 11. Second base portion 14 includes a majority of a middle area of base portion 10. Third base portion 16 is an area of base portion 10 that includes first base aperture 50 and a base terminal end 13.

In this embodiment, second base portion 14 includes a second base aperture 52 positioned near first base portion 12. The size, shape, and location of second base aperture 52 may vary to accommodate various tools, tasks, needs, and situations. One or more base apertures 53 are optionally included as additional fixing locations. In this embodiment, a third base aperture 53*a* shown adjacent to and proximate to a corner 93. In the present embodiment, the base portion 10 is shown as having an approximately hexagonal shape with a plurality of corners 90, 93, 95, 97, and 99.

Anchor portion 30 includes a first anchor portion 32, a second anchor portion 34, and a third anchor portion 36 that coincides with first base portion 12, second base portion 14, and third base portion 16 of base portion 10. First anchor portion 32 includes an anchor connected end 31. Third anchor portion 36 includes an anchor terminal end 33.

In the present embodiment, anchor portion 30 has a first anchor aperture 60 and a second anchor aperture 62. This embodiment shows first anchor aperture 60 positioned in third anchor portion 36. Second anchor aperture 62 is shown in second anchor portion 34, and second anchor aperture 62 is shown aligned and co-axial with second base aperture 52. It is contemplated that first anchor aperture 60 into which is pressed threaded rod 42 is not necessary if threaded rod 42 is attached in position to anchor portion 30 such as, for example, by welding or other bonding techniques including, but not limited to, adhesives and the like.

In this embodiment, each of the plurality of anchor apertures 60 and 62 are circular. As with all of the apertures, the shape, size, and location may vary to accommodate various tools, tasks, needs, and situations. If a first anchor aperture 60 is included, then the diameter is typically between 0.0625 inch and 0.25 inch with a typical diameter of about 0.125 inch. The diameter of the second anchor aperture 62 is typically between 0.0625 inch and 0.75 inch with a typical diameter of about 0.375 inch. As with the plurality of apertures in base portion 30, the apertures in anchor portion 30 also extend through the entirety of anchor portion 30.

In the present embodiment, anchor portion 30 is shown as having an approximately quadrilateral shape. In particular, the present embodiment shows anchor 30 as having a generally rectangular shape.

The length and width of base portion 10 has a base length 72 and a base width 74 while anchor portion 30 has an anchor length 82 and an anchor width 84. Base length 72 can be compared to base width 74 to achieve a base ratio. A preferred base ratio is between approximately 1.5 and approximately 3.0 such that base length 72 is slightly longer than base width 74 up to approximately three times longer than base width 74.

In one embodiment of the present invention, base length 72 is between 2 inches and 5 inches long with a typical length being approximately 3.75 inches. In one embodiment of the present invention, base width 74 is between 1 inch and 3 inches long with a typical length being approximately 2 inches plus or minus 0.03125 inch.

The anchor length 82 can be compared to anchor width 84 to achieve an anchor ratio. A preferred anchor ratio is between approximately 2.0 and approximately 6.0 such that anchor length 82 is between approximately two times anchor width 84 and approximately six times anchor width 84.

In one embodiment of the present invention, anchor length 82 is between 2 inches and 5 inches with a typical length of approximately 3.75 inches. In one embodiment of the present invention, anchor width 84 is between 0.5 inch and 2 inches with a typical acceptable width of approximately 0.75 inch.

Base length 72 can be compared to anchor length 82 to achieve a base-anchor length ratio. A preferred base-anchor length ratio is between approximately 0.5 and approximately 2.0 such that the base length 72 is between approximately half anchor length 82 and approximately twice anchor length 82.

Base width 74 can be compared to anchor width 84 to achieve a base-anchor width ratio. A preferred base-anchor width ratio is between approximately 1.5 and approximately 3.0 such that base width 74 is between approximately slightly larger than anchor width 84 and approximately three times anchor width 84.

FIG. 5 is a right side plan view of clip 100. As FIG. 6 illustrates, threaded rod 42 of fastener 40 is countersunk to the anchor portion 30 and nut 46 on threaded rod 42 prevents base portion 10 from moving away from anchor portion 30 such that threaded rod 42 is no longer disposed through first base aperture 50. Washer 44 is disposed between nut 46 and base portion 10. FIG. 5 also shows base portion 10 connected to anchor portion 30 via connector portion 20. Additionally, this view shows base portion 10 being substantially parallel to anchor portion 30.

As previously described, base portion 10 has first base portion 12, second base portion 14, and third base portion 16. Base portion 10 has base connected end 11 and a base terminal end 17 opposite base connected end 11. Base connected end 11 is adjacent to first base portion 12 and base terminal end 17 is adjacent to third base portion 16.

Similarly and as previously describe, anchor portion 30 has first anchor portion 32, second anchor portion 34, and third anchor portion 36. Anchor portion 30 has anchor connected end 31 and an anchor terminal end 37 opposite anchor connected end 31. Anchor connected end 31 is adjacent anchor first portion 32, and anchor terminal end 37 is adjacent anchor third portion 36.

FIG. 6 is a bottom, plan view of removable clip 100 showing base portion 10 with first base aperture 50, second base aperture 52 and a plurality of third base apertures 53*a*, 53*b*, 53*c*, and 53*d* extending through the base portion 10. The plurality of third base apertures 53*a*, 53*b*, 53*c*, and 53*d* are proximate to corners 93, 95, 97, and 99, respectively. The fastener 40 is shown as a bolt 42. The clip 100 in FIG. 6 is different from the clip 100 in FIG. 3 in that it shows fastener 40 with neither washer 44 nor nut 46 and only threaded rod 42. As a result, base portion 10 around threaded rod 42, first base aperture 50 through which threaded rod 42 protrudes, and anchor portion 30 are all visible.

The present embodiment shows the first base aperture 50 as having an elongated shape. In the present embodiment, first base aperture 50 has a length between 0.0625 inch and 0.75 inch with a typical length of about 0.375 inch. First base aperture 50 has a width between 0.0625 inch and 0.75 inch with a typical width of about 0.25 inch.

Although second base aperture 52 is depicted as circular, it may have any shape desired. As shown in FIG. 6, the circular diameter of second base aperture 52 is typically between 0.0625 inch and 0.25 inch with a typical length of about 0.125 inch.

FIG. 7 is a cross-sectional, right side view of the clip 100. As is more clearly shown, the at least a rod 42 of fastener 40 extends transversely from anchor portion 30 and through first base aperture 50 in base portion 10.

Base portion 10 and anchor portion 30 may have the same thickness or different thicknesses. In this embodiment, clip 100 is made from the same piece of sheet material, which material may be metal, plastic, wood, composites, and the like. The thickness is typically in a range of about 0.03125 inch or greater; more typically in a range of about 0.03125 inch to about 0.125 inch but could be thicker if so desired. In any event, the thickness in not limiting.

Connector portion 20 determines the spacing between base portion 10 and anchor portion 30. If connector portion 20 is a separate component, then its thickness determines the spacing between base portion 10 and anchor portion 30. If connector portion 20 is part of the same sheet of material used to make base portion 10 and anchor portion 30 and if the material is bendable, then it is the size (i.e. radius) of the bend that determines the spacing between base portion 20 and anchor portion 30. For example, a 0.125 radius bend will provide a small space between base portion 20 and anchor portion 30 than a 0.1875 radius. The space between the base portion 10 and the anchor portion 30 of clip 100 is configured to receive an intervening unit such as a belt, tool belt, tool holder, holster, or tool holster. The thickness and/or radius bend of connector portion 20 may be sized to accommodate any of these intervening units. Thus, in one embodiment of the present invention, the connector thickness (or radius bend) may be between 0.125 inch and 0.5 inch.

Figure 8:
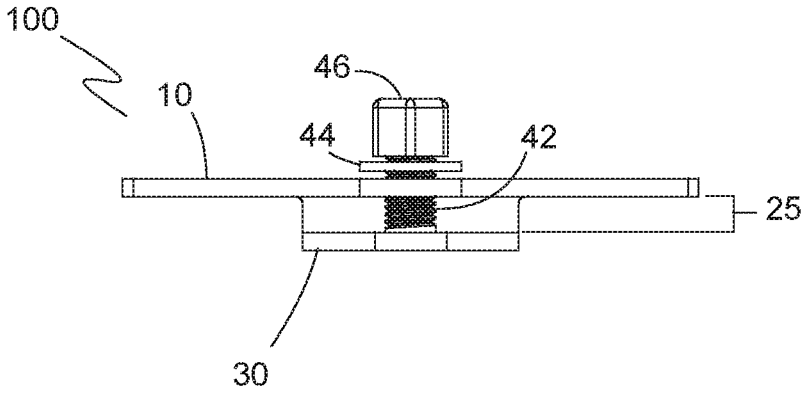
FIG. 8 is a rear plan view of the clip shown in FIG. 1.

FIG. 8 is a front end view of clip 100. FIG. 8 shows the spacing 25 between base portion 10 and anchor portion 30 as well as threaded rod 42, washer 44 and nut 46. It is contemplated that, when clip 100 is attached to a tool holster, a hole is formed in the holster just large enough to permit threaded rod 42 to pass through the tool holster wall then through first base aperture 50 with final fixing to the holster wall by nut 46 being threaded onto threaded rod 42.

Figure 9:
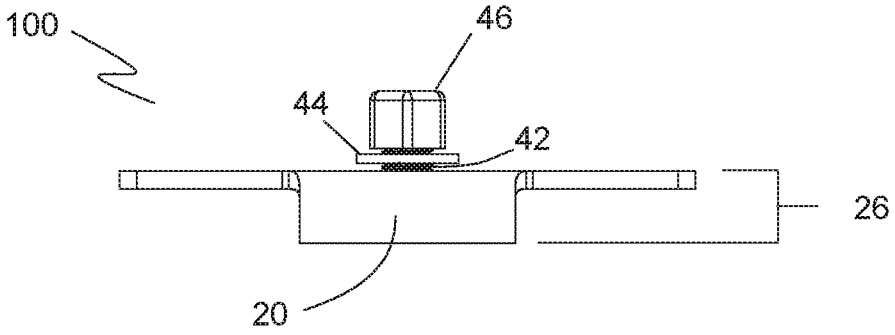
FIG. 9 is a front plan view of the clip shown in FIG. 1.

FIG. 9 is a back end view of clip 100 showing connector portion 20. Connector portion 20 is shown here having a connector thickness 26 if connector portion 20 is the result of a radius bend of the material. If connector portion 20 is a separate piece, then thickness 26 would be equal to the spacing between base portion 10 and anchor portion 30. Fastener 40 is shown here as having threaded rod 42, washer 44, and nut 46.

Figure 10:
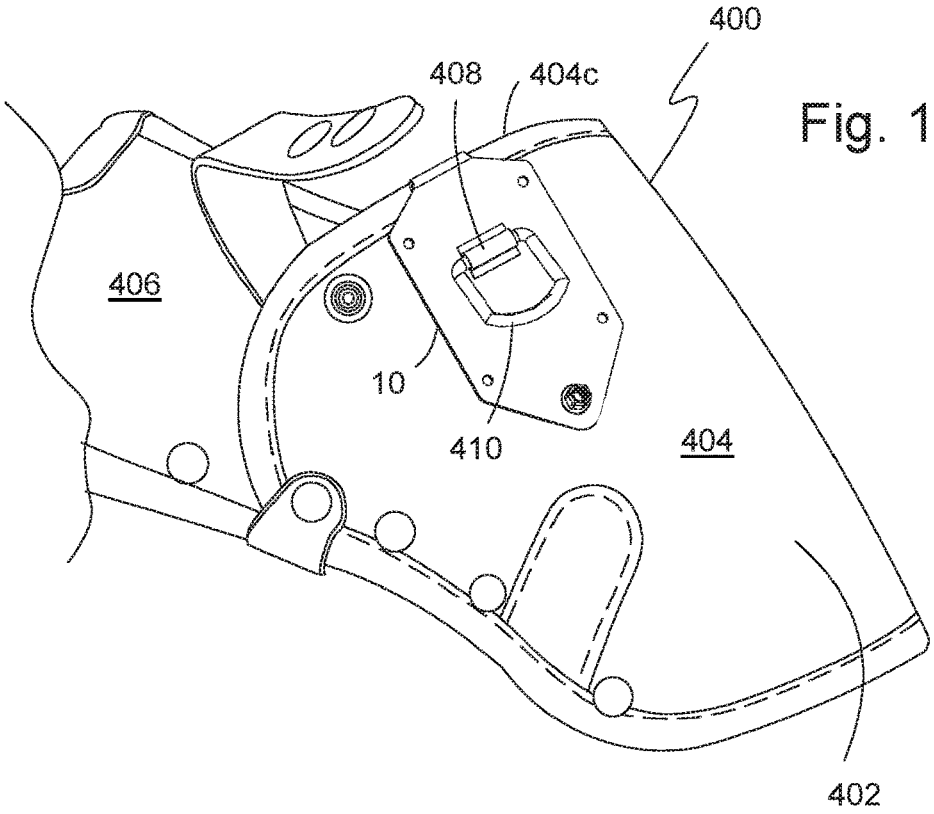
FIG. 10 is a perspective view of one embodiment of the present invention showing the removable clip attached to one embodiment of a holster where the removable clip has a D-ring.

FIG. 10 is a perspective of clip 100 attached to one embodiment of a tool holster 400. Holster 400 has a tool pouch 402 formed by a pouch wall 404 being fixedly attached to a holster rear wall 406. Pouch wall 404 may be a separate piece from holster rear wall 406 or it may be a portion of rear wall 406 that is folded over and secured to holster rear wall 406 to form tool pouch 404. Pouch wall 404 is also considered an intervening structure 404. In this embodiment, clip 100 is attached to tool holster 400 to form a combination 600. This perspective shows the base portion 10 disposed on an outside surface 404*a* of pouch wall 404. Anchor portion 30 is not visible as it is disposed on an inside surface 404*b* (not shown) of pouch wall 404. Connector portion 20 is positioned adjacent a pouch top edge 404*c*.

In this embodiment of the invention, fastener 40 extends from anchor portion 30 through pouch wall 404 of tool holster 400 via an aperture formed in pouch wall 404, securing to the base portion 10. In the present embodiment, a D-ring 410 is shown attached to the base portion 10 via a D-ring securing mechanism 408 that optionally permits the D-ring to pivot within the D-ring securing mechanism 408.

Figure 11:
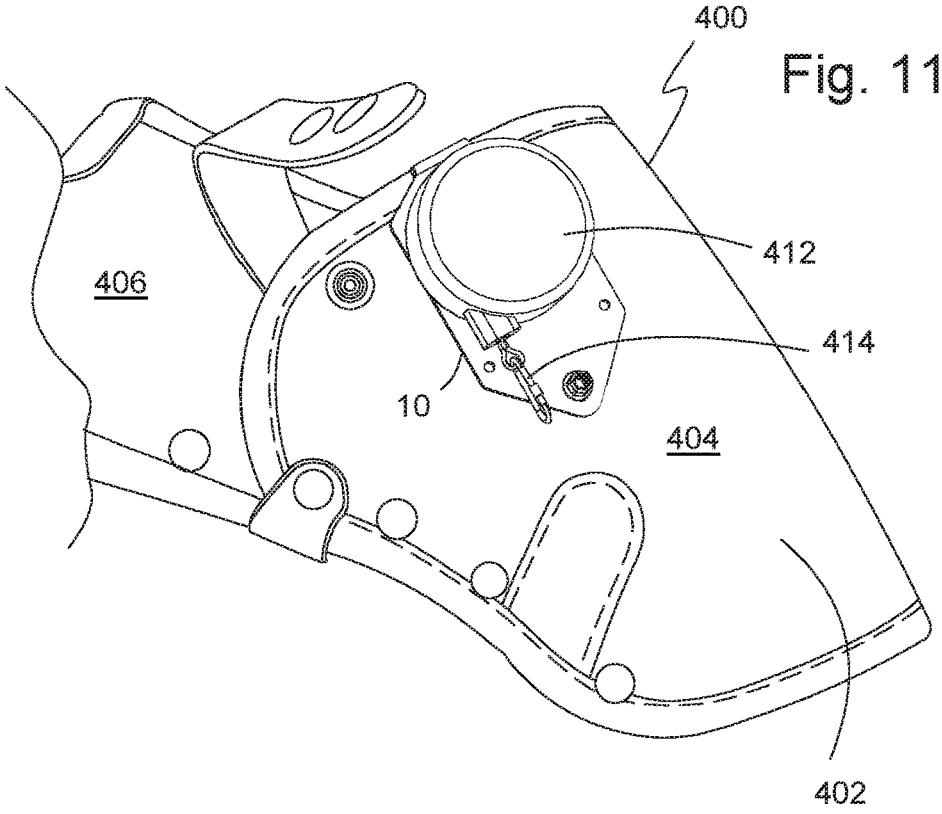
FIG. 11 is a perspective view of one embodiment of the present invention showing the removable clip attached to the holster shown in FIG. 10 where the removable clip has a retractable lanyard.

FIG. 11 is a perspective view of another embodiment of the present invention. In this embodiment, clip 100 is attached to tool holster 400 in a similar way as described for FIG. 10 previously. In this embodiment, the D-ring is replaced with a retractable lanyard 412 with a carabiner attachment 414.

Figure 12:
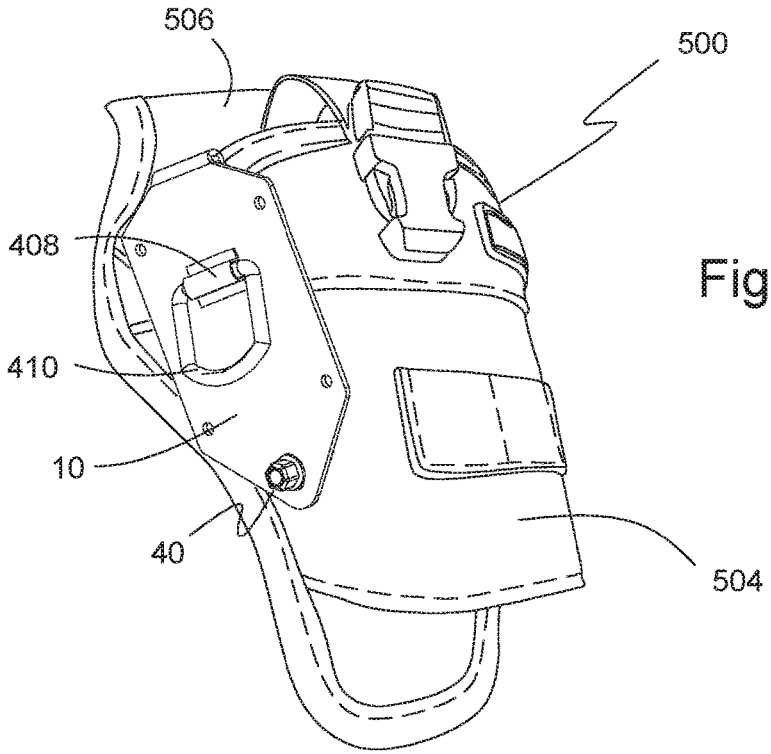
FIG. 12 is a perspective view of one embodiment of the present invention showing the removable clip attached to another embodiment of a holster where the removable clip has a D-ring.
Figure 13:
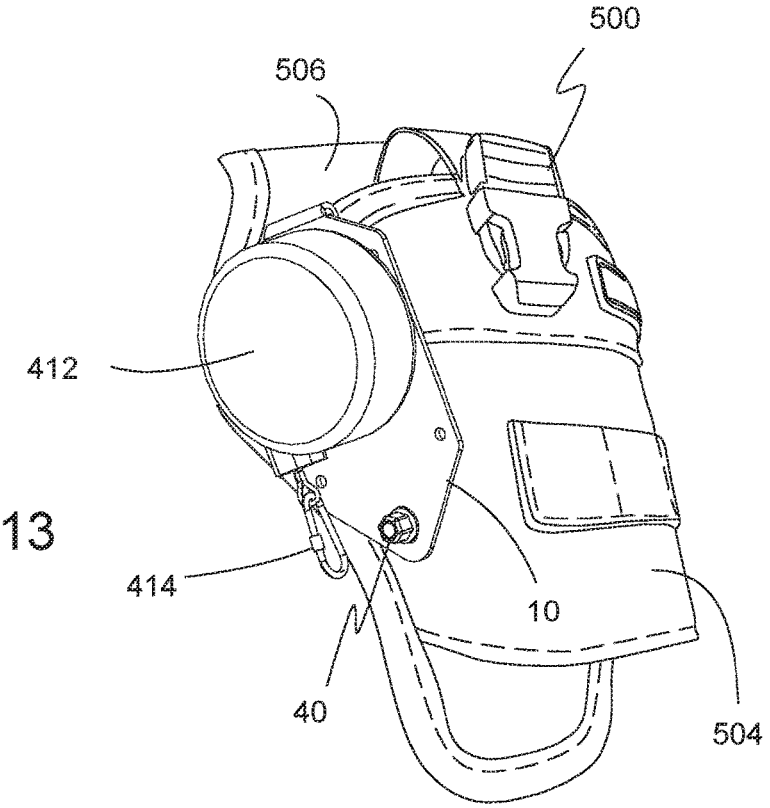
FIG. 13 is a perspective view of one embodiment of the present invention showing the removable clip attached to the holster shown in FIG. 12 where the removable clip has a retractable lanyard.

Turning now to FIGS. 12 and 13, there is illustrated another embodiment of a tool holster 500. Clip 100 of the present invention is attached in a similar way to a tool pouch 504. Like FIG. 10, FIG. 12 has a D-ring 410 attached to base portion 10. Like FIG. 11, FIG. 13 has a retractable lanyard 412 with carabiner 414 attached to base portion 10.

The present invention may be constructed using many different types of material. In the preferred embodiments, the clip 100 is made of a resilient and rigid or semi-rigid material, such as steel, iron, or other similar material. In the preferred embodiments, holster 400, 500 is made of a resilient and flexible or semi-flexible material such as ballistic nylon, polyester ballistic, leather, or other similar material.

Various terminology may be used to describe various embodiments of the present invention. Some of the equivalents are provided herein. The clip 100 may also be referred to as a clip body. The base portion 10 may also be referred to as a first portion. The connector portion 20 may also be referred to as a second portion, a bend portion, or a bend. The anchor portion 30 may also be referred to as a third portion. The fastener 40 may also be referred to as a fastening member. The tool holster 402 may also be referred to as a holster, intervening unit, tool pouch, tool holder, or tool receptacle.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. In combination, a tool holster and a clip, comprising:

a tool holster having at least one sidewall wherein the at least one sidewall is formed into a pouch having a pouch wall; and a clip attached to the tool holster, the clip comprising:

a base portion having a first base aperture through the base portion and disposed adjacent a base terminal end;

an anchor portion having a fastener with at least a rod extending transversely from the anchor portion adjacent an anchor terminal end and through the first base aperture of the base portion; and a connector portion connecting the base portion at a base connected end to the anchor portion at an anchor connected end, wherein the connector portion is a bend portion connecting the base portion to the anchor portion, wherein the base portion and the anchor portion are facing each other in an opposed parallel orientation and spaced from each other, wherein the base portion has a base width and the anchor portion has an anchor width, the base width being wider than the anchor width, wherein the base portion has a second base aperture positioned to not overlap with the anchor portion, wherein a portion of the pouch wall is disposed between the base portion and the anchor portion with the at least a rod penetrating through the pouch wall and through the first base aperture of the base portion to thereby secure the clip to the pouch wall of the tool holster.

2. The combination of claim 1 wherein the at least a rod of the fastener is a threaded rod and wherein the fastener further includes a nut threadably disposed on the threaded rod to thereby secure the clip to the pouch wall.

3. The combination of claim 1 wherein the base portion is outside of the pouch and further includes a D-ring secured to the base portion.

4. The combination of claim 1 wherein the base portion is outside of the pouch and further includes a retractable lanyard secured to the base portion.

5. A clip comprising:

a base portion having a first base portion, a second base portion, and a third base portion with a first base aperture, wherein the second base portion connects the first base portion to the third base portion, wherein the base portion has a base terminal end adjacent the third base portion and a base connected end adjacent the first base portion, wherein the base terminal end is opposite said base connected end, and wherein the first base aperture is adjacent the base terminal end, further wherein the base portion has a base width and a second base aperture;

a connector portion attached to the first base portion at the base connected end;

an anchor portion having a first anchor portion, a second anchor portion, and a third anchor portion wherein the second anchor portion connects the first anchor portion to the third anchor portion, wherein the anchor portion has an anchor terminal end adjacent to the third anchor portion and an anchor connected end adjacent to the first anchor portion, wherein the anchor terminal end is opposite the anchor connected end, and wherein the anchor connected end is connected to the connector portion, further wherein the anchor portion has an anchor width;

wherein the base width is greater than the anchor width and the second base aperture is positioned to not overlap with the anchor portion;

wherein the connector portion is a bend portion connecting the base portion to the anchor portion; and a fastener having at least a rod attached to the third anchor portion adjacent the anchor terminal end and wherein said the at least a rod of the fastener extends transversely from the anchor portion toward and through the first base aperture of the base portion.

6. The clip of claim 5 wherein the base portion and the anchor portion are comprised of a rigid material and the at least a rod of the fastener is countersunk to the anchor portion.

7. The clip of claim 5 wherein the at least a rod is a threaded rod and the fastener further includes a nut removably attached to the threaded rod, and a washer disposed on the threaded rod between the nut and the base portion.

8. The clip of claim 5 wherein the base portion has a base length, and a base thickness, the anchor portion has an anchor length, and an anchor thickness, and the anchor portion is parallel to the base portion.

9. The clip of claim 8 wherein the base length to the base width defines a base ratio in the range of 1.5 to 3.0.

10. The clip of claim 8 wherein the anchor length to the anchor width defines an anchor ratio in the range of 1.5 to 3.0.

11. The clip of claim 5 wherein the base portion further comprises one or more base apertures; the anchor portion further comprises one or more anchor apertures; and at least one of the one or more anchor apertures is aligned with at least one of the one or more base apertures.

12. The clip of claim 11 wherein the base portion forms a hexagonal shape, the hexagonal shape has corners, at least one of the one or more base apertures are disposed proximate to at least one of the corners.

13. The clip of claim 11 wherein the anchor portion forms a quadrilateral shape.

14. A clip comprising:

a unitary clip body having a bend in the clip body and forming a base portion and an anchor portion with the bend forming a connector portion wherein the base portion and the anchor portion are parallel to and spaced from each other, wherein the base portion has a base terminal end opposite the bend and a base connected end adjacent the bend, wherein the anchor portion has an anchor terminal end opposite the bend and an anchor connected end adjacent to the bend, wherein the base portion has a base width and a base aperture, further wherein the anchor portion has an anchor width; wherein the base width is greater than the anchor width and the base aperture is positioned to not overlap with the anchor portion; and a fastener having at least a rod attached adjacent to the anchor terminal end wherein the at least a rod extends transversely from the anchor portion toward and through a first base aperture adjacent to the base terminal end of the base portion and a rod attaching component removably connected to the at least a rod.

15. The clip of claim 14 wherein the base portion and the anchor portion are comprised of a rigid material and the at least a rod of the fastener is countersunk to the anchor portion.

16. The clip of claim 14 wherein the at least a rod is a threaded rod and the fastener further includes a nut removably attached to the threaded rod, and a washer disposed on the threaded rod between the nut and the base portion.

17. The claim of claim 14 wherein a base length to base width defines a base ratio in the range of 1.5 to 3.0.

18. The clip of claim 14 wherein an anchor length to anchor width defines an anchor ratio in the range of 1.5 to 3.0.

19. The clip of claim 14 wherein the base portion comprises a plurality of base apertures; the anchor portion further comprises one or more anchor apertures; and at least one of the one or more anchor apertures is aligned with at least one of the one or more base apertures.

* * * * *